US012268932B2

(12) United States Patent
Moore

(10) Patent No.: US 12,268,932 B2
(45) Date of Patent: Apr. 8, 2025

(54) STAIRCASE EXERCISE APPARATUS

(71) Applicant: Thomas Moore, Chicago, IL (US)

(72) Inventor: Thomas Moore, Chicago, IL (US)

( * ) Notice: Subject to any disclaimer, the term of this patent is extended or adjusted under 35 U.S.C. 154(b) by 92 days.

(21) Appl. No.: 18/229,367

(22) Filed: Aug. 2, 2023

(65) Prior Publication Data

US 2025/0041660 A1 Feb. 6, 2025

(51) Int. Cl.
*A63B 23/04* (2006.01)

(52) U.S. Cl.
CPC .. *A63B 23/0458* (2013.01); *A63B 2208/0204* (2013.01)

(58) Field of Classification Search
CPC ..... A63B 22/04; A63B 23/0458–047
See application file for complete search history.

(56) References Cited

U.S. PATENT DOCUMENTS

| | | | | | |
|---|---|---|---|---|---|
| 3,592,466 | A * | 7/1971 | Parsons | A63B 22/04 | 482/53 |
| 4,687,195 | A * | 8/1987 | Potts | A63B 22/04 | 482/52 |
| 4,726,581 | A * | 2/1988 | Chang | A63B 22/04 | 482/53 |
| 4,822,029 | A * | 4/1989 | Sarno | A63B 22/0023 | 482/52 |
| 5,145,475 | A * | 9/1992 | Cares | A63B 21/157 | 482/52 |
| 5,328,420 | A * | 7/1994 | Allen | A63B 22/0023 | 482/52 |
| 5,769,759 | A * | 6/1998 | Alter | A63B 22/04 | 482/37 |
| 5,833,576 | A | 11/1998 | Henmi | | |
| 7,144,351 | B2 | 12/2006 | Kastelic | | |
| 8,702,571 | B2 * | 4/2014 | Fenster | A63B 21/0051 | 482/52 |
| D748,286 | S | 1/2016 | Murray | | |
| D760,852 | S | 7/2016 | Appleton | | |
| 9,623,286 | B1 * | 4/2017 | Chen | A63B 24/0087 | |
| 10,428,531 | B2 | 10/2019 | Pindrik | | |
| 10,918,086 | B2 | 2/2021 | Sarver | | |
| 11,660,477 | B2 * | 5/2023 | Whitty | A62B 35/0062 | 182/3 |
| 2012/0184409 | A1 * | 7/2012 | Beal | A63B 69/0048 | 482/5 |
| 2017/0304674 | A1 * | 10/2017 | Johnson | A63B 22/04 | |
| 2017/0326407 | A1 * | 11/2017 | Johnson | A63B 22/203 | |
| 2019/0022455 | A1 * | 1/2019 | Kueker | A63B 21/0058 | |
| 2019/0387706 | A1 | 12/2019 | Bachman | | |
| 2022/0203160 | A1 * | 6/2022 | Stratigos | A63B 21/4034 | |

FOREIGN PATENT DOCUMENTS

| | | | | |
|---|---|---|---|---|
| CN | 111202948 A * | 5/2020 | | A63B 23/0464 |
| GB | 2441388 | 5/2008 | | |

* cited by examiner

*Primary Examiner* — Nyca T Nguyen

(57) ABSTRACT

An exercise apparatus for supporting a pair of feet of a user while the user moves a body of the user alternately up and down a staircase with the user's hands includes the staircase with a pair of stirrups for supporting the pair of feet of the user. The pair of stirrups are slidably alternately up and down the staircase, enabling the user to move the user's body up and down the staircase using the user's hands. The user may also perform push-ups and other exercises while supporting the user's feet on the stirrups.

16 Claims, 9 Drawing Sheets

STAIRCASE EXERCISE APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to exercise apparatus and more particularly pertains to a new exercise apparatus for supporting a pair of feet of a user while the user moves a body of the user alternately up and down a staircase via the user's hands.

(2) Description of Related Art Including Information Disclosed Under 37 CFR 1.97 and 1.98

The prior art discloses exercise apparatuses which use staircases in various arrangements for a user to scale by running, jumping, stepping, or the like. However, the prior art does not provide an exercise apparatus which supports a user's feet while the user moves the user's body alternately up and down the staircase by his or her hands to exercise muscles in the user's upper body. Such an apparatus provides a unique alternative to other upper body exercises and facilitates a different mode of usage than the exercise apparatuses of the prior art involving staircases.

BRIEF SUMMARY OF THE INVENTION

An embodiment of the disclosure meets the needs presented above by generally comprising a staircase which is elongated between a front side and a rear side. The staircase comprises a plurality of steps and a pair of sidewalls. The steps of the plurality of steps are interconnected. A lowermost step of the plurality of steps is positioned at the front side of the staircase, and an uppermost step of the plurality of steps is positioned at the rear side of the staircase. Each step of the plurality of steps is coupled to and extends between the pair of sidewalls. A platform is coupled to the staircase and is positioned at the front side of the staircase. A pair of upper tracks is coupled to the staircase, each of which is positioned on an associated one of the pair of sidewalls and extends from the front side of the staircase to the rear side of the staircase. A pair of lower tracks is coupled to the platform, each of which is aligned with an associated one of the pair of upper tracks and extends forwardly from a back side of the platform. Each one of a pair of stirrups is slidably coupled to an associated one of the pair of lower tracks and is movable to slidably engage an associated one of the pair of upper tracks. Each stirrup of the pair of stirrups is configured to hold an associated one of a pair of feet of a user.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
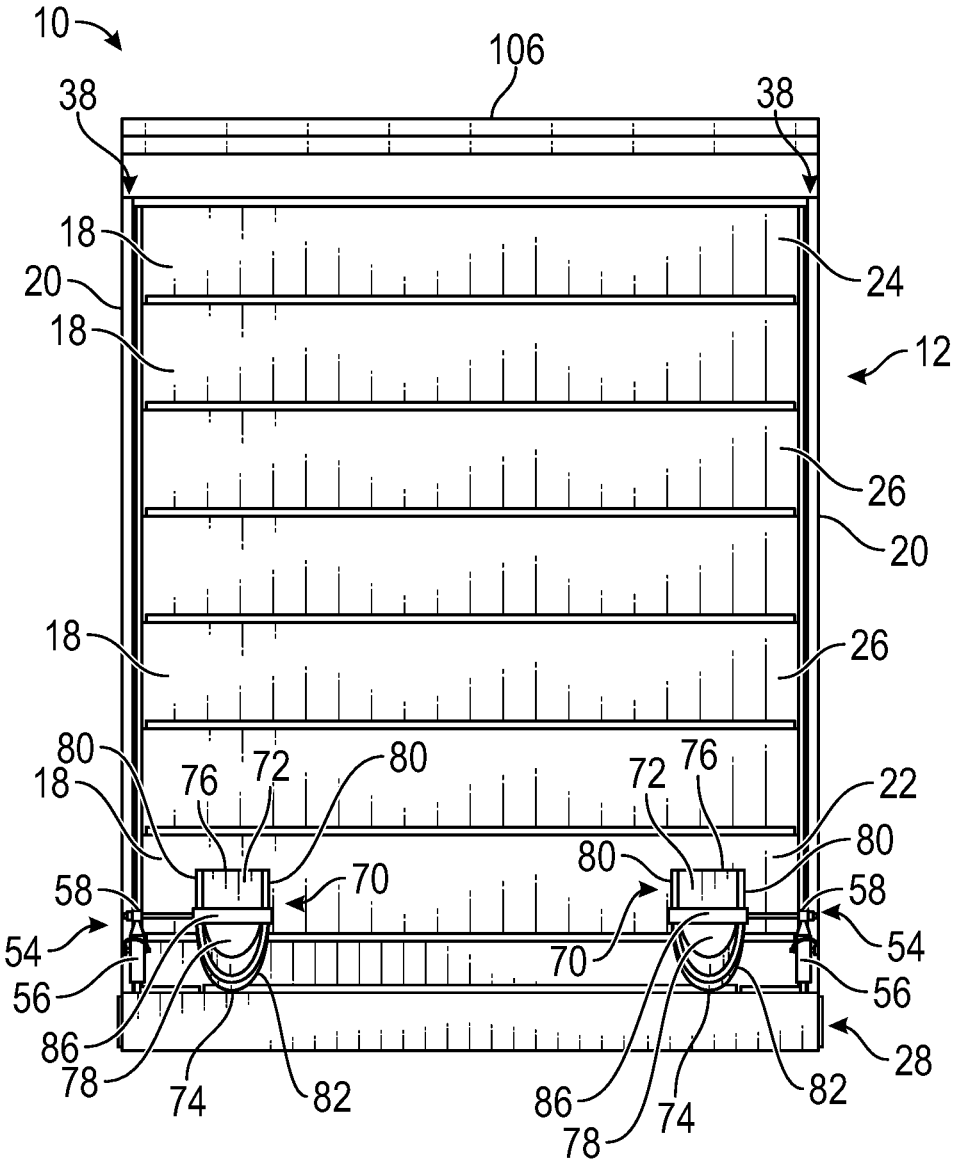
FIG. 1 is a front view of an exercise apparatus according to an embodiment of the disclosure.
Figure 2:
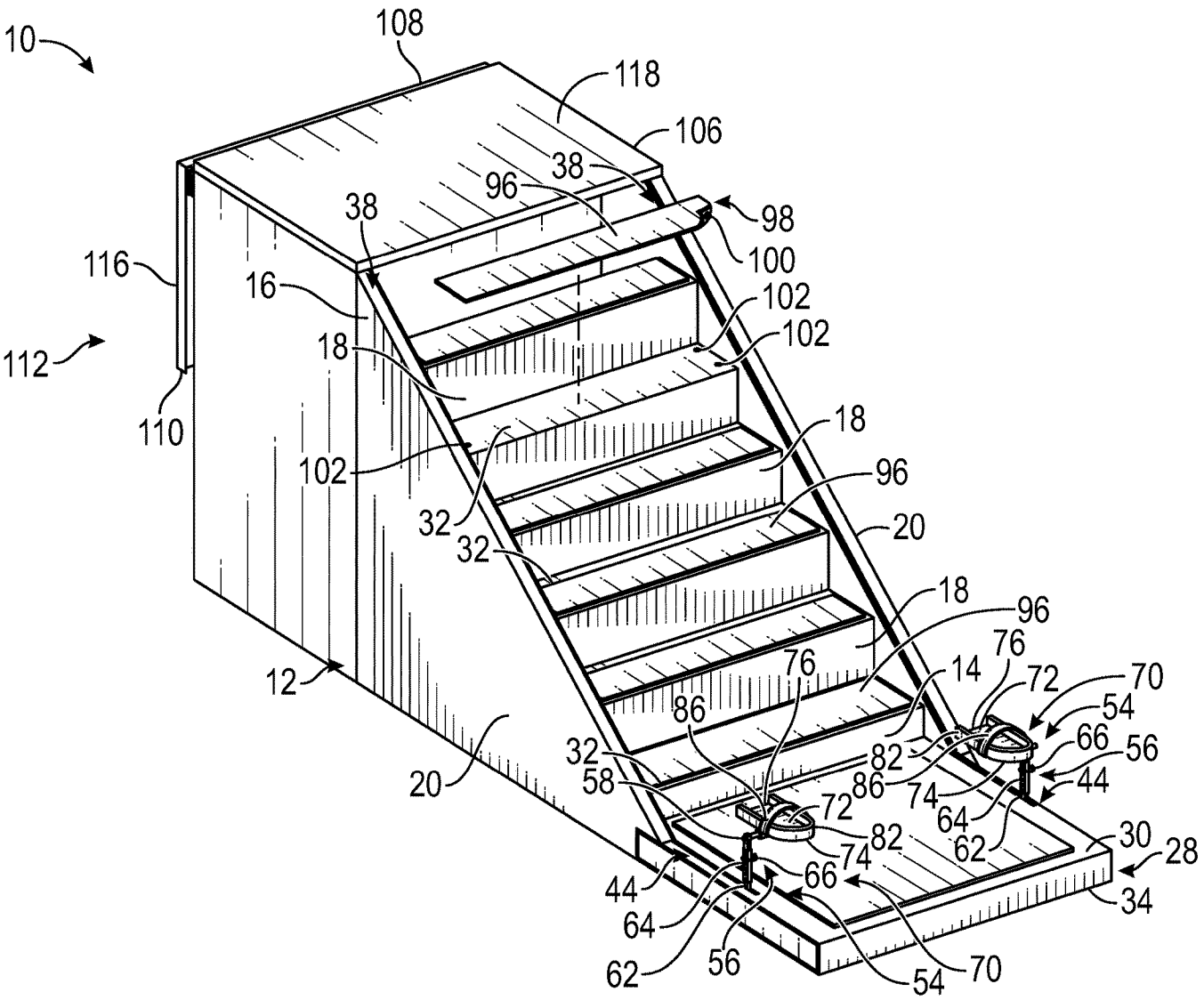
FIG. 2 is a perspective view of an embodiment of the disclosure.
Figure 3:
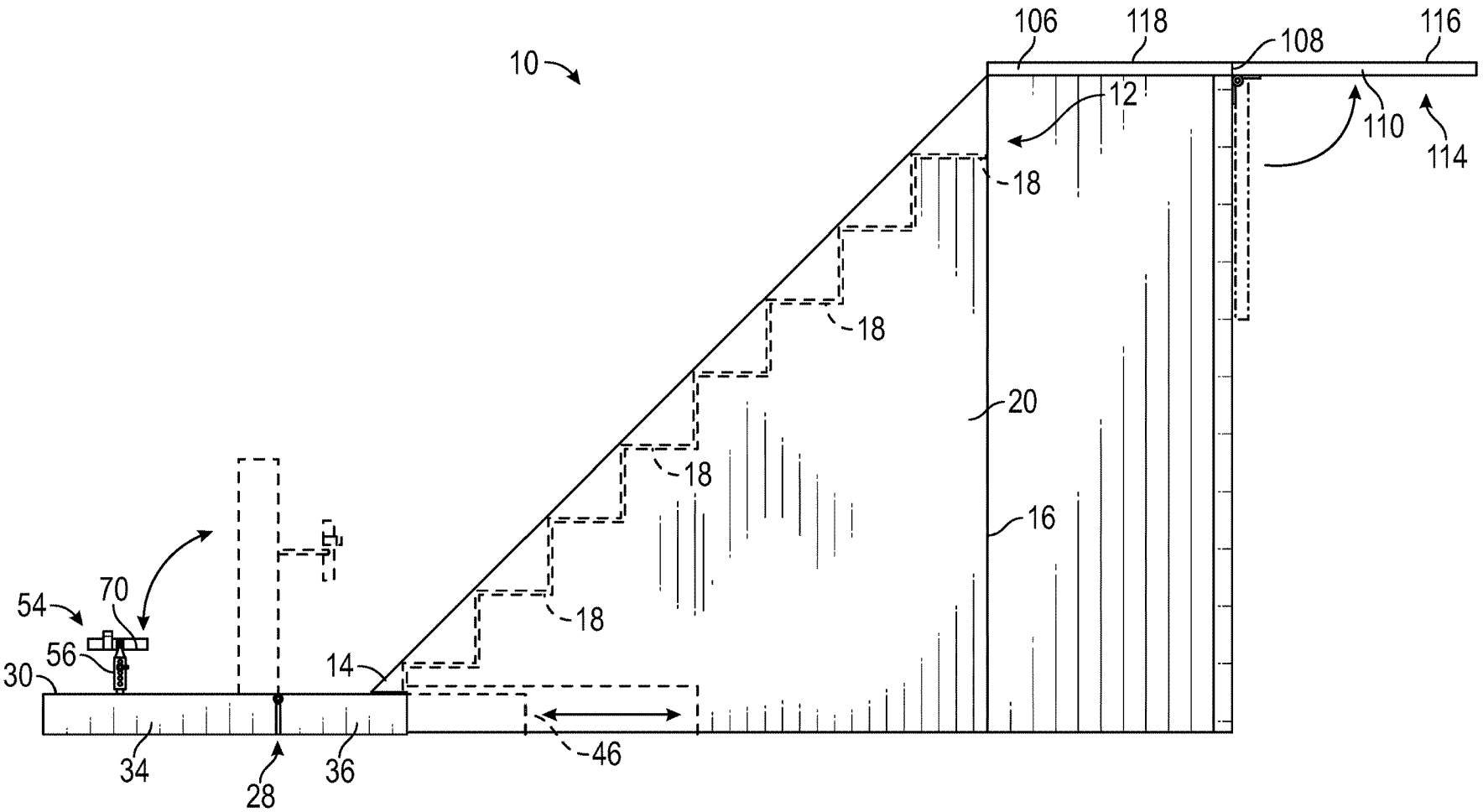
FIG. 3 is a side view of an embodiment of the disclosure.
Figure 4:
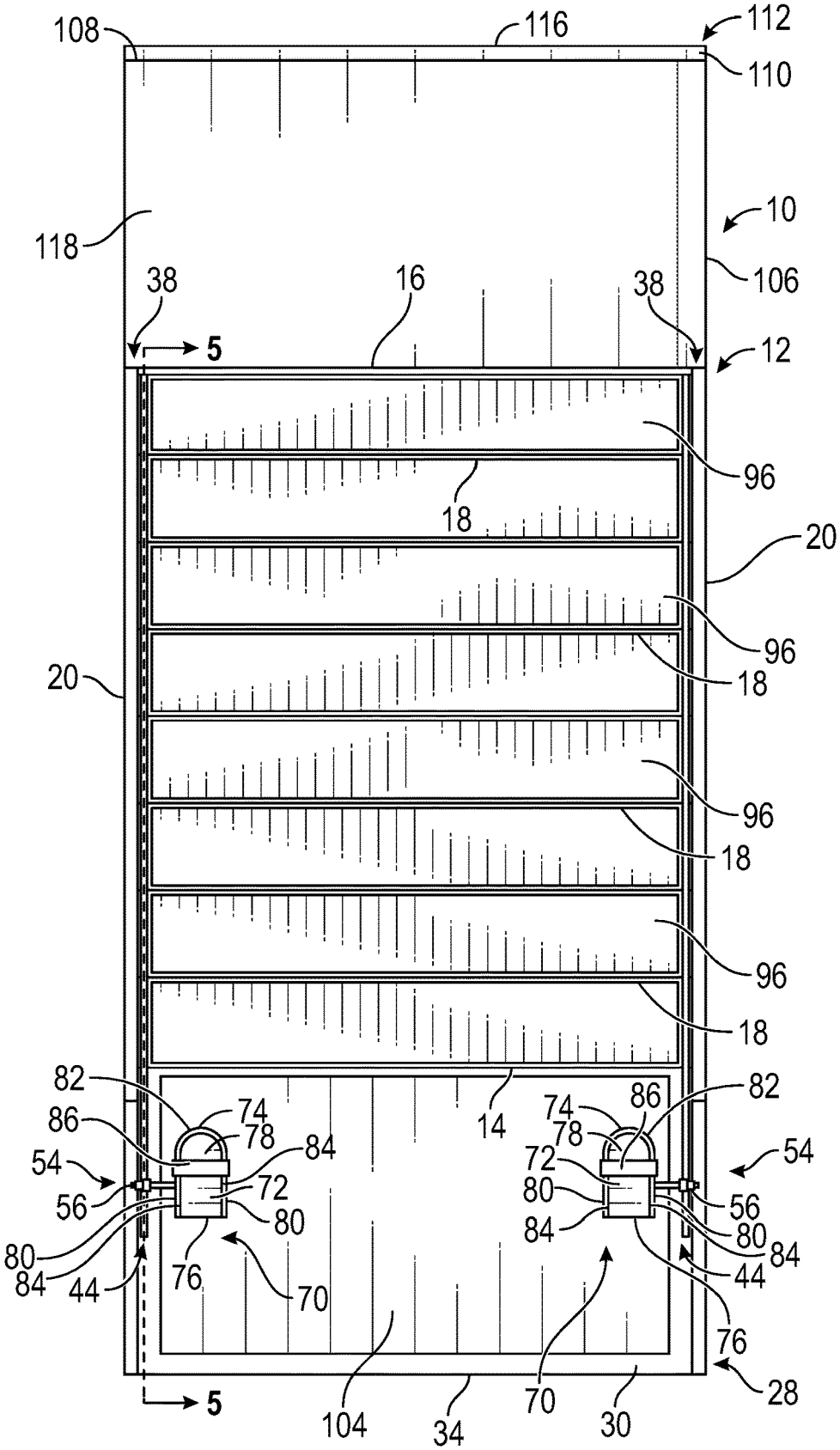
FIG. 4 is a top view of an embodiment of the disclosure.
Figures 5, 6, 7:
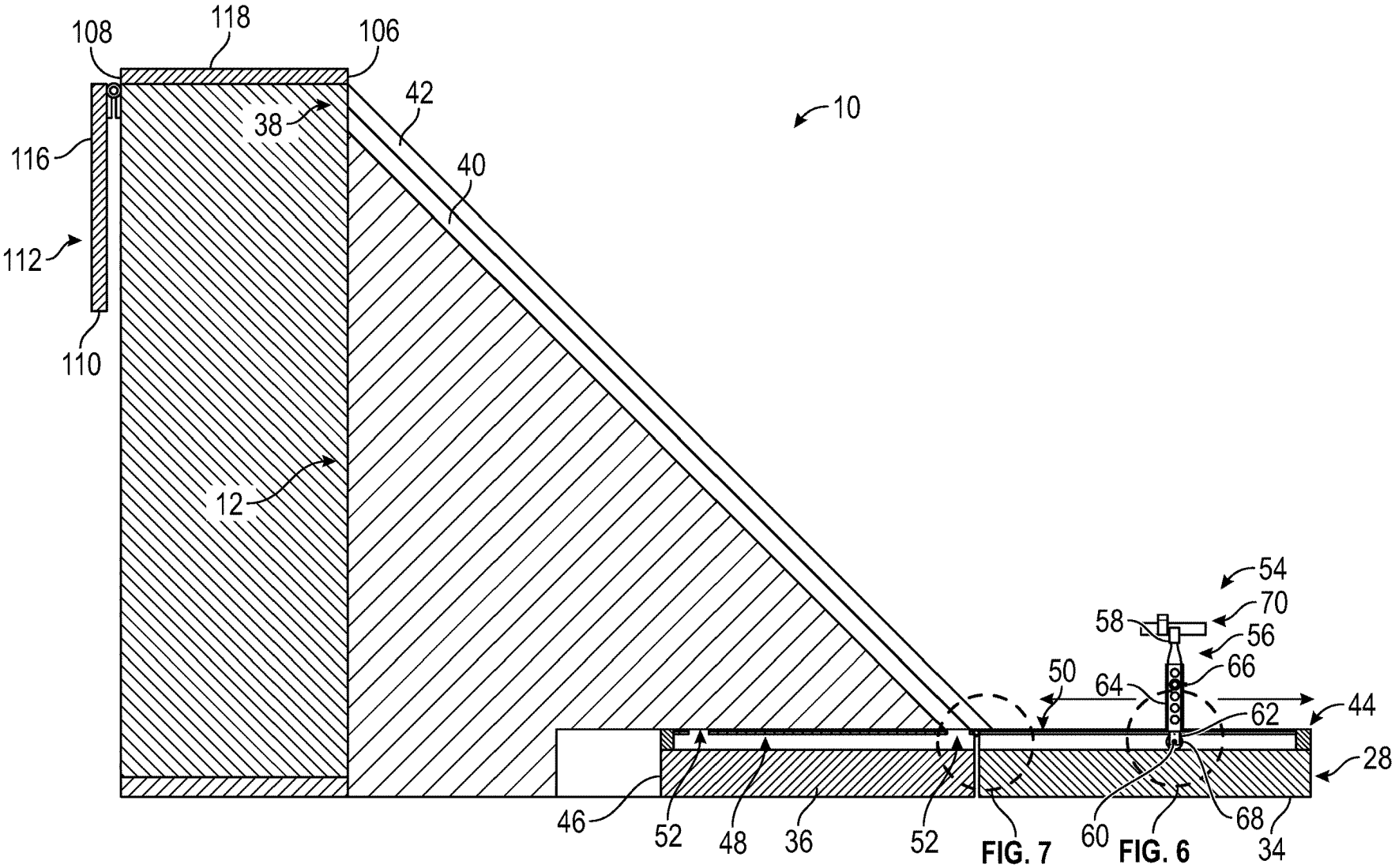
FIG. 5 is a cross-section view of an embodiment of the disclosure taken from Arrows 5-5 in FIG. 4.
FIG. 6 is a detail view of an embodiment of the disclosure taken from Circle 6 in FIG. 5.
FIG. 7 is a detail view of an embodiment of the disclosure taken from Circle 7 in FIG. 5.
Figure 6:
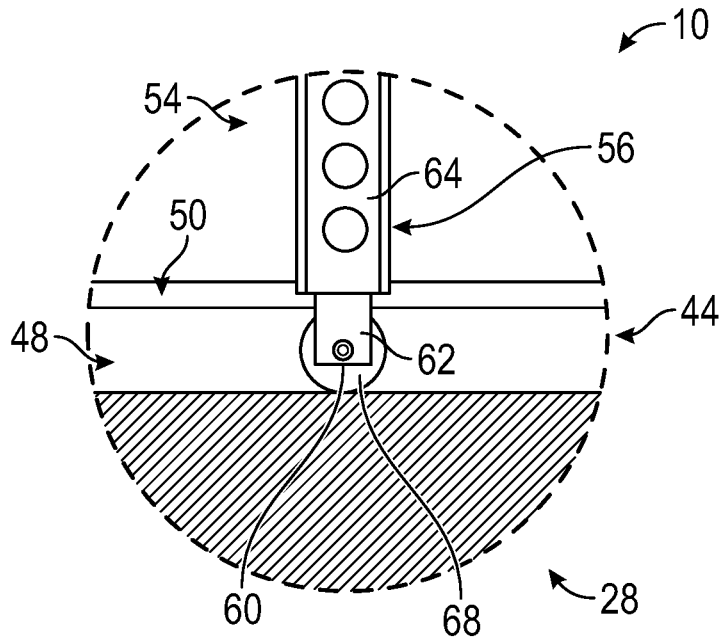
Figure 7:
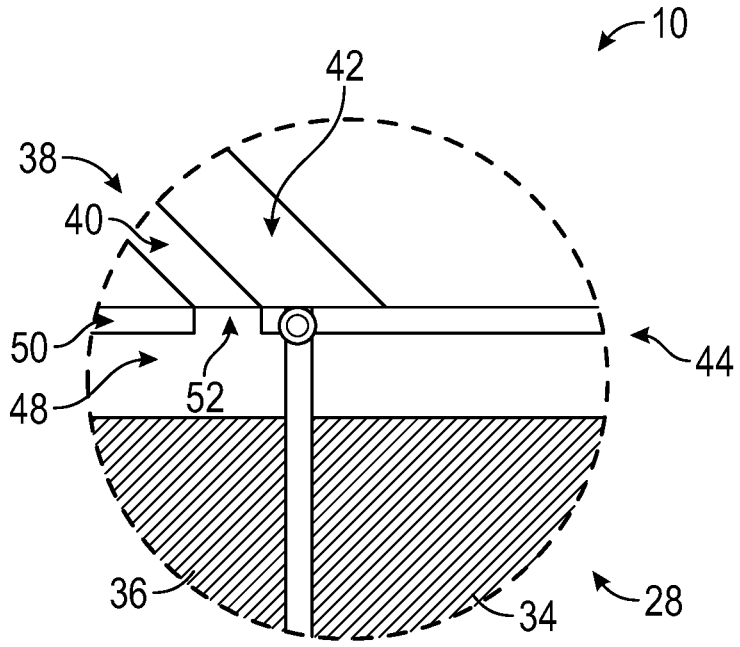
Figure 8:
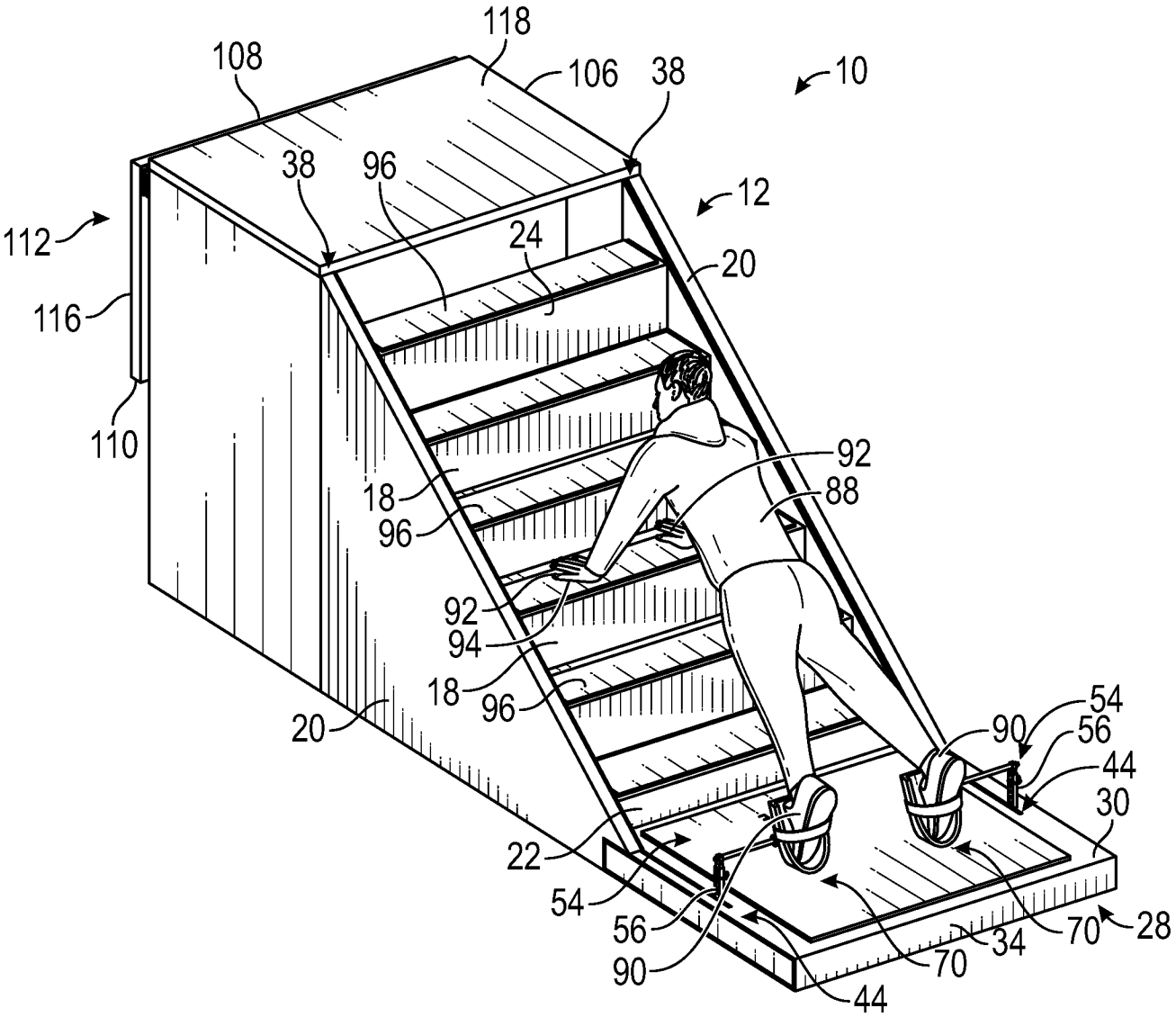
FIG. 8 is an in-use view of an embodiment of the disclosure.
Figure 9:
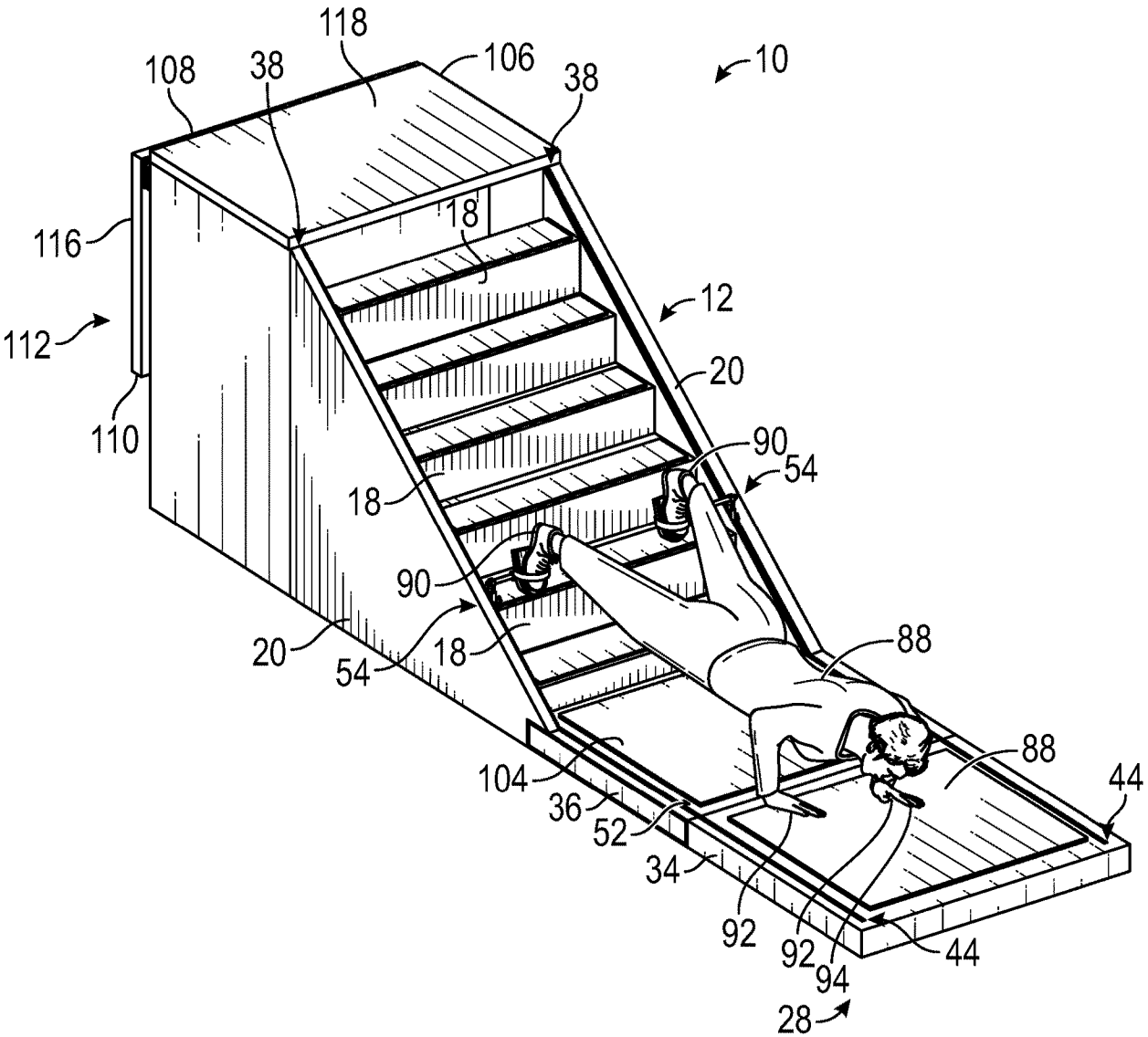
FIG. 9 is an in-use view of an embodiment of the disclosure.
Figure 10:
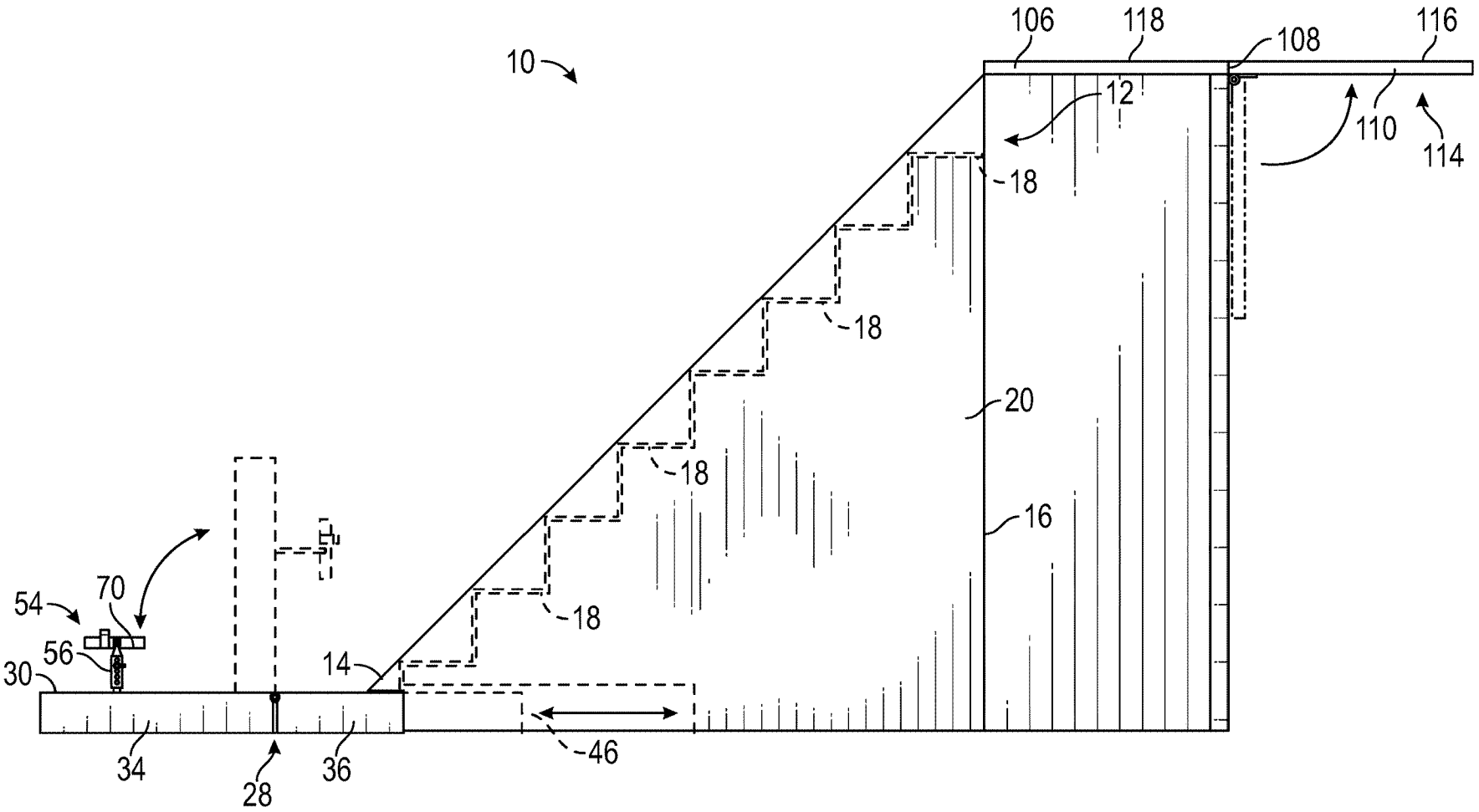
FIG. 10 is a side view of an embodiment of the disclosure with a landing extension in a deployed configuration.

With reference now to the drawings, and in particular to FIGS. 1 through 10 thereof, a new exercise apparatus embodying the principles and concepts of an embodiment of the disclosure and generally designated by the reference numeral 10 will be described.

As best illustrated in FIGS. 1 through 10, the exercise apparatus 10 generally comprises a staircase 12 is elongated between a front side 14 and a rear side 16. The staircase 12 comprises a plurality of steps 18 and a pair of sidewalls 20. The plurality of steps 18 is interconnected and includes a lowermost step 22, an uppermost step 24, and a plurality of intermediate steps 26. The plurality of intermediate steps 26 is arranged between the lowermost step 22 and the uppermost step 24. The lowermost step 22 is positioned at the front side 14 of the staircase 12, and the uppermost step 24 is positioned at the rear side 16 of the staircase 12. The plurality of steps 18 is evenly spaced from each other, and each step 18 of the plurality of steps 18 is coupled to and extends between the pair of sidewalls 20. A plurality of casters or other lockable wheels may be mounted to the staircase 12 to facilitate easy movement of the staircase 12 and to selectively fix the staircase 12 in place with respect to a floor surface or the like during use.

A platform 28 is coupled to the staircase 12 and is positioned at the front side 14 of the staircase 12. A top surface 30 of the platform 28 is spaced below an upper surface 32 of the lowermost step 22, and the platform 28 is slidable forwardly with respect to the staircase 12. The platform 28 comprises a first section 34 and a second section 36 which are pivotally interconnected. The first section 34 is positioned forwardly of the second section 36 with respect to the staircase 12 and is pivotable upwardly with respect to the second section 36.

A pair of upper tracks 38 is coupled to the staircase 12, each of which is positioned on an associated one of the pair of sidewalls 20 and extends from the front side 14 of the staircase 12 to the rear side 16 of the staircase 12. Each upper track 38 of the pair of upper tracks 38 comprises an upper channel 40 which extends through the associated sidewall 20 and an upper slot 42 which extends downwardly into the sidewall 20 to the upper channel 40. The upper slot 42 extends along a full length of the upper channel 40, and a width of the upper slot 42 is less than a width of the upper channel 40.

A pair of lower tracks 44 is coupled to the platform 28, each of which is aligned with an associated one of the pair of upper tracks 38 and extends forwardly from a back side 46 of the platform 28. Each lower track 44 of the pair of lower tracks 44 comprises a lower channel 48 which extends through the platform 28 and a lower slot 50 which extends downwardly into the platform 28 to the lower channel 48. The lower slot 50 extends along a full length of the lower channel 48, and a width of the lower slot 50 is less than a width of the lower channel 48. The lower slot 50 also has a pair of openings 52 extending downwardly through the platform 28 to the lower channel 48. A width of each opening 52 of the pair of openings 52 is greater than the width of the lower slot 50.

Each one of a pair of stirrups 54 is slidably coupled to an associated one of the pair of lower tracks 44 and is movable to slidably engage an associated one of the pair of upper tracks 38. Each stirrup 54 of the pair of stirrups 54 comprises a support arm 56, a wheel 68, and a receiver 70. The support arm 56 extends through the lower slot 50 of the lower track 44. A top end 58 of the support arm 56 is alternately extendable from and retractable toward a bottom end 60 of the support arm 56. The support arm 56 has a bottom member 62 and a top member 64 which are slidably coupled to each other. Each stirrup 54 of the pair of stirrups 54 also comprises a locking pin 66 which is insertable through the top member 64 and the bottom member 62 of the support arm 56 to secure the top end 58 of the support arm 56 at a selected distance from the bottom end 60. The wheel 68 is rotatably coupled to the bottom end 60 of the support arm 56 and is positioned in the lower channel 48 of the associated lower track 44. The wheel 68 is movable to the upper channel 40 of the associated upper track 38 only through either one of the pair of openings 52 of the associated lower track 44 when the opening 52 is aligned with the upper channel 40 of the associated upper track 38 such that the stirrup 54 is slidably coupled to the associated upper track 38.

The receiver 70 is mounted to the top end 58 of the support arm 56 and is configured to hold an associate one of a pair of feet 90 of a user 88. The receiver 70 is pivotable about a horizontal axis which extends transversely to the staircase 12. The receiver 70 comprises a panel 72, a lip 82, and a strap 86. The panel 72 has a first end 74 and a second end 76, and a central axis of the panel 72 extending through the first end 74 and the second end 76 is oriented perpendicular to the horizontal axis of the receiver 70. The panel 72 has an engagement surface 78 extending between the first end 74 and the second end 76. The lip 82 extends along a pair of lateral edges 80 of the panel 72 and around the first end 74. The lip 82 protrudes away from the engagement surface 78. The strap 86 is coupled to and extends between a pair of lateral portions 84 of the lip 82. The strap 86 forms a closed loop with the lip 82 and the panel 72 which has a size such that the closed loop is configured for receiving the associated foot 90.

Each one of a plurality of step pads 96 is coupled to an upper surface 32 of an associated one of the plurality of steps 18. Each step pad 96 of the plurality of step pads 96 comprises a compressible material such that the step pad 96 is configured for conforming to an outer surface 94 of the user 88 when the user 88 presses the outer surface 94 into the step pad 96. Each step pad 96 thereby absorbs a force exerted by the user 88 when the user 88 presses into the step pad 96. Each connector 98 of a plurality of connectors 98 is coupled to an associated one of the plurality of steps 18 and an associated one of the plurality of step pads 96 to releasably attach the associated step pad 96 to the associated step 18. Each connector 98 of the plurality of connectors 98 comprises a first mating member 100 which is coupled to the associated step pad 96 and a second mating member 102 which is coupled to the associated step 18. Each connector 98 comprises a snap fastener but may comprise a latch, a zipper, a hook-and-loop fastener, or the like. Each one of a pair of platform pads 104 is mounted on a top surface 30 of the platform 28 on an associated one of the first section 34 and the second section 36 of the platform 28. Each platform pad 104 of the pair of platform pads 104 comprises the compressible material used for the step pads 96. The platform pads 104 may also be removable from the platform 28 via releasable fasteners.

A landing 106 is coupled to the staircase 12 and is positioned at the rear side 16 of the staircase 12. The landing 106 extends rearwardly with respect to the staircase 12 from the staircase 12 and terminates in a distal end 108 of the landing 106 with respect to the staircase 12. A landing extension 110 is coupled to the landing 106 at the distal end 108 of the landing 106. The landing extension 110 is movable between a folded position 112 and a deployed position 114. An upper support surface 116 of the landing extension 110 extends downwardly from the landing 106 when the landing extension 110 is positioned in the folded position 112, and the upper support surface 116 lies on a shared plane with a top side 118 of the landing 106 and extends rearwardly from the landing 106 when the landing extension 110 is positioned in the deployed position 114. A locking hinge 120 couples the landing extension 110 to the landing 106, the locking hinge 120 being lockable to secure the landing extension 110 in the deployed position 114.

In use, the platform 28 is positioned such that each of the first section 34 and the second section 36 of the platform 28 lie adjacent to each other on a support surface. The platform 28 is also positioned in relation to the staircase 12 to expose enough of the platform 28 for use as follows. Each foot 90 of the pair of feet 90 is positioned in the receiver 70 of an associated one of the pair of stirrups 54. The user 88 may be oriented to extend either forwardly or rearwardly from said pair of stirrups 54 with respect to the staircase 12, and a pair of hands 92 of the user 88 are placed over one or both of the platform 28 and the staircase 12 to support the user 88 thereon. In this position, the user 88 may exercise by moving up or down the plurality of steps 18 of the staircase 12 by urging the user's 88 hands 92 against the exercise apparatus 10 in an alternating fashion similar to walking. The user 88 may also perform push-ups, planking exercises, or similar while in the position described. The height of the user's 88 feet 90 above the exercise apparatus 10 may be adjusted by adjusting the distance of the top end 58 of the support arm 56 of each stirrup 54 of the pair of stirrups 54 from the bottom end 60 of the support arm 56. To compactly store the exercise apparatus 10, the platform 28 may be slid rearwardly with respect to the staircase 12 and the first section 34 of the platform 28 may be pivoted upwardly and toward the staircase 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An exercise apparatus comprising:

a staircase being elongated between a front side and a rear side, the staircase comprising a plurality of steps and a pair of sidewalls, the plurality of steps being interconnected, a lowermost step of the plurality of steps being positioned at the front side of the staircase, an uppermost step of the plurality of steps being positioned at the rear side of the staircase, each step of the plurality of steps being coupled to and extending between the pair of sidewalls;

a platform being coupled to the staircase, the platform being positioned at the front side of the staircase;

a pair of upper tracks being coupled to the staircase, each upper track of the pair of upper tracks being positioned on an associated one of the pair of sidewalls and extending from the front side of the staircase to the rear side of the staircase;

a pair of lower tracks being coupled to the platform, each lower track of the pair of lower tracks being aligned with an associated one of the pair of upper tracks and extending forwardly from a back side of the platform; and a pair of stirrups, each stirrup of the pair of stirrups being slidably coupled to an associated one of the pair of lower tracks, each stirrup of the pair of stirrups being movable to slidably engage an associated one of the pair of upper tracks, each stirrup of the pair of stirrups being configured to hold an associated one of a pair of feet of a user.

2. The apparatus of claim 1, wherein:

each upper track of the pair of upper tracks comprises an upper channel extending through the associated sidewall and an upper slot extending downwardly into the sidewall to the upper channel, the upper slot extending along a full length of the upper channel, a width of the upper slot being less than a width of the upper channel; and each lower track of the pair of lower tracks comprising a lower channel extending through the platform and a lower slot extending downwardly into the platform to the lower channel, the lower slot extending along a full length of the lower channel, a width of the lower slot being less than a width of the lower channel, the lower slot having a pair of openings extending downwardly through the platform to the lower channel, a width of each opening of the pair of openings being greater than the width of the lower slot.

3. The apparatus of claim 2, wherein each stirrup of the pair of stirrups comprises a support arm extending through the lower slot of the lower track, the support arm having a bottom end and a top end, a receiver being mounted to the top end of the support arm, the receiver being shaped such that the receiver is configured for holding the associated foot.

4. The apparatus of claim 3, wherein the top end of the support arm is alternately extendable from and retractable toward the bottom end, the support arm having a bottom member and a top member being slidably coupled to each other.

5. The apparatus of claim 4, wherein each stirrup of the pair of stirrups further comprises a locking pin being insertable through the top member and the bottom member of the support arm to secure the top end of the support arm at a selected distance from the bottom end.

6. The apparatus of claim 3, wherein the receiver being pivotable about a horizontal axis extending transversely to the staircase.

7. The apparatus of claim 3, wherein the receiver comprises:

a panel having a first end and a second end, a central axis of the panel extending through the first end and the second end being oriented perpendicular to the horizontal axis of the receiver, the panel having an engagement surface extending between the first end and the second end;

a lip extending along a pair of lateral edges of the panel and around the first end, the lip protruding away from the engagement surface; and a strap being coupled to and extending between a pair of lateral portions of the lip, the strap forming a closed loop with the lip and the panel, the closed loop having a size such that the closed loop is configured for receiving the associated foot.

8. The apparatus of claim 3, wherein each stirrup of the pair of stirrups further comprises a wheel being rotatably coupled to the bottom end of the support arm, the wheel being positioned in the lower channel of the associated lower track, the wheel being movable to the upper channel of the associated upper track only through either one of the pair of openings of the associated lower track when the opening is aligned with the upper channel of the associated upper track such that the stirrup is slidably coupled to the associated upper track.

9. The apparatus of claim 1, further comprising a plurality of step pads, each step pad of the plurality of step pads being coupled to an upper surface of an associated one of the plurality of steps, each step pad of the plurality of step pads comprising a compressible material such that the step pad is configured for conforming to an outer surface of the user when the user presses the outer surface into the step pad.

10. The apparatus of claim 9, further comprising a plurality of connectors, each connector of the plurality of connectors being coupled to an associated one of the plurality of steps and an associated one of the plurality of step pads to releasably attach the associated step pad to the associated step, each connector of the plurality of connectors comprising a first mating member being coupled to the associated step pad and a second mating member being coupled to the associated step.

11. The apparatus of claim 10, wherein each connector comprises a snap fastener.

12. The apparatus of claim 1, wherein the platform is slidable forwardly with respect to the staircase, the platform comprising a first section and a second section being pivotally interconnected, the first section being positioned forwardly of the second section with respect to the staircase, the first section being pivotable upwardly with respect to the second section.

13. The apparatus of claim 12, further comprising a pair of platform pads, each platform pad of the pair of platform pads being mounted on a top surface of the platform on an associated one of the first section and the second section of the platform, each platform pad of the pair of platform pads comprising the compressible material.

14. The apparatus of claim 1, wherein the steps of the plurality of steps are evenly spaced from each other.

15. The apparatus of claim 1, wherein a top surface of the platform is spaced below an upper surface of the lowermost step.

16. An exercise apparatus comprising:

a staircase being elongated between a front side and a rear side, the staircase comprising a plurality of steps and a pair of sidewalls, the plurality of steps being interconnected, the plurality of steps including a lowermost step, an uppermost step, and a plurality of intermediate steps, the plurality of intermediate steps being arranged between the lowermost step and the uppermost step, the lowermost step being positioned at the front side of the staircase, the uppermost step being positioned at the rear side of the staircase, the plurality of steps being evenly spaced from each other, each step of the plurality of steps being coupled to and extending between the pair of sidewalls;

a platform being coupled to the staircase, the platform being positioned at the front side of the staircase, a top surface of the platform being spaced below an upper surface of the lowermost step, the platform being slidable forwardly with respect to the staircase, the platform comprising a first section and a second section being pivotally interconnected, the first section being positioned forwardly of the second section with respect to the staircase, the first section being pivotable upwardly with respect to the second section;

a pair of upper tracks being coupled to the staircase, each upper track of the pair of upper tracks being positioned on an associated one of the pair of sidewalls and extending from the front side of the staircase to the rear side of the staircase, each upper track of the pair of upper tracks comprising an upper channel extending through the associated sidewall and an upper slot extending downwardly into the sidewall to the upper channel, the upper slot extending along a full length of the upper channel, a width of the upper slot being less than a width of the upper channel;

a pair of lower tracks being coupled to the platform, each lower track of the pair of lower tracks being aligned with an associated one of the pair of upper tracks and extending forwardly from a back side of the platform, each lower track of the pair of lower tracks comprising a lower channel extending through the platform and a lower slot extending downwardly into the platform to the lower channel, the lower slot extending along a full length of the lower channel, a width of the lower slot being less than a width of the lower channel, the lower slot having a pair of openings extending downwardly through the platform to the lower channel, a width of each opening of the pair of openings being greater than the width of the lower slot;

a pair of stirrups, each stirrup of the pair of stirrups being slidably coupled to an associated one of the pair of lower tracks, each stirrup of the pair of stirrups being movable to slidably engage an associated one of the pair of upper tracks, each stirrup of the pair of stirrups comprising:

a support arm extending through the lower slot of the lower track, the support arm having a bottom end and a top end, the top end being alternately extendable from and retractable toward the bottom end, the support arm having a bottom member and a top member being slidably coupled to each other;

a wheel being rotatably coupled to the bottom end of the support arm, the wheel being positioned in the lower channel of the associated lower track, the wheel being movable to the upper channel of the associated upper track only through either one of the pair of openings of the associated lower track when the opening is aligned with the upper channel of the associated upper track such that the stirrup is slidably coupled to the associated upper track;

a receiver being mounted to the top end of the support arm, the receiver being pivotable about a horizontal axis extending transversely to the staircase, the receiver comprising:

a panel having a first end and a second end, a central axis of the panel extending through the first end and the second end being oriented perpendicular to the horizontal axis of the receiver, the panel having an engagement surface extending between the first end and the second end;

a lip extending along a pair of lateral edges of the panel and around the first end, the lip protruding away from the engagement surface; and a strap being coupled to and extending between a pair of lateral portions of the lip, the strap forming a closed loop with the lip and the panel, the closed loop having a size such that the closed loop is configured for receiving an associated one of a pair of feet of a user; and a locking pin being insertable through the top member and the bottom member of the support arm to secure the top end of the support arm at a selected distance from the bottom end;

a plurality of step pads, each step pad of the plurality of step pads being coupled to an upper surface of an associated one of the plurality of steps, each step pad of the plurality of step pads comprising a compressible material such that the step pad is configured for conforming to an outer surface of the user when the user presses the outer surface into the step pad;

a plurality of connectors, each connector of the plurality of connectors being coupled to an associated one of the plurality of steps and an associated one of the plurality of step pads to releasably attach the associated step pad to the associated step, each connector of the plurality of connectors comprising a first mating member being coupled to the associated step pad and a second mating member being coupled to the associated step, each connector comprising a snap fastener;

a pair of platform pads, each platform pad of the pair of platform pads being mounted on a top surface of the platform on an associated one of the first section and the second section of the platform, each platform pad of the pair of platform pads comprising the compressible material;

a landing being coupled to the staircase, the landing being positioned at the rear side of the staircase, the landing extending rearwardly with respect to the staircase from the staircase and terminating in a distal end of the landing with respect to the staircase; and a landing extension being coupled to the landing at the distal end of the landing, the landing extension being movable between a folded position and a deployed position, an upper support surface of the landing extension extending downwardly from the landing when the landing extension is positioned in the folded position, the upper support surface lying on a shared plane with a top side of the landing and extending rearwardly from the landing when the landing extension is positioned in the deployed position.

* * * * *